United States Patent [19]

Veneklasen

[11] 4,363,493

[45] Dec. 14, 1982

[54] UNI-WHEEL SKATE

[76] Inventor: Paul S. Veneklasen, Santa Monica, Calif.

[21] Appl. No.: 182,486

[22] Filed: Aug. 29, 1980

[51] Int. Cl.[3] ..... A63C 17/08; A63C 17/14

[52] U.S. Cl. ..... 280/11.2; 280/11.24; 280/11.36

[58] Field of Search ..... 280/11.24, 11.25, 87.04 A, 280/87.04 R, 11.36, 11.1 R, 11.1 BT, 11.1 ET, 11.2, 11.21, 11.19, 205, 206, 207, 208

[56] References Cited

U.S. PATENT DOCUMENTS

| | | | |
|---|---|---|---|
| 2,520,793 | 8/1950 | Blackwell | 280/11.24 |
| 3,663,031 | 5/1972 | Young | 280/11.24 |

FOREIGN PATENT DOCUMENTS

| | | | |
|---|---|---|---|
| 109529 | 5/1928 | Austria | 280/11.24 |
| 2117349 | 10/1971 | Fed. Rep. of Germany | 280/208 |
| 571303 | 1/1924 | France | 280/11.1 ET |
| 812803 | 2/1937 | France | 280/11.24 |
| 857276 | 4/1940 | France | 280/11.1 ET |
| 108952 | 6/1925 | Switzerland | 280/11.24 |

*Primary Examiner*—Joseph F. Peters, Jr.
*Assistant Examiner*—Milton L. Smith
*Attorney, Agent, or Firm*—William W. Haefliger

[57] ABSTRACT

A uni-wheel skate has a circular wheel which has a rim arranged to rotate about a frame having a generally tilted axis so that the rim rotates in a plane which is generally tilted relative to the vertical. The frame has satellite rollers rotatably attached to the frame and engaging the rim so as to permit the rim to rotate about the frame. A foot support is pivotally carried by the frame and receives the rider's foot for transmission of the rider's body load to and through the frame to the wheel. A separate support is associated with the frame to be rotatable relative to the frame to be engaged with the rider's leg to maintain stability. The pivotable foot support may be provided with brake pads for engaging the rim.

21 Claims, 8 Drawing Figures

UNI-WHEEL SKATE

BACKGROUND OF THE INVENTION

This invention relates generally to self-powered locomotions, and more particularly concerns a novel uni-wheel skate usable for that purpose.

A survey of devices designed for self-powered locomotion discloses factors which can be improved. The device described herein has many advantages over several time honored and common vehicles.

The improved uni-wheel skate device, as will be seen, is manipulated for self-propulsion in much the same manner as with roller skates or ice skates. All the motions and balance principles are common to walking. The rider alternately rides and strokes from one foot to the other. The propulsive force is generated by allowing the loaded foot to veer off to the outside of the travel path while the rider falls onto the other foot and, at the final instant of fall, strokes vigorously. The magnitude of the forward force vector component depends on the angular divergence of the track of the loaded foot from the travel path and the vigor of the final stroke.

When ice skating, the resistance to forward motion is determined by the coefficient of friction between the skate blade and the ice. The ice under the blade is usually momentarily melted under the pressure of the blade and the water lubricates the sliding contact, so that the friction is very little. At speed, the air resistance is the dominant drag factor.

When roller skating, the air resistance is the same as for ice skating at the same velocity. However, the rolling friction is generally much greater and depends on the smoothness of the road bed, increasing greatly with surface roughness or particle size.

In the subject device the inner surface of a rolling rim furnishes a smooth rolling surface for a low friction satellite roller which supports the rider. The outer surface or tire of the rim, being much larger in diameter than the satellite roller, rolls much more easily on the roadbed and is less affected by surface roughness than would be the case if the small support roller had to roll directly on the roadbed. Thus, in effect, the rolling rim is continuously and progressively laying down a smooth runway for the smaller support roller. Two other small rollers also ride the inner rim to orient the rider's foot plate within the rim. The foot plate is attached to a light framework that includes the support roller and the two guide follers.

Whereas an earlier device of mono-cycle nature was required to use a large diameter rim to enclose the rider, in the present device it is desired that the diameter of the rolling rims be of smaller size to favor portability of the system. Therefore, while the lower edge of the rim is in contact with the roadway and supports the rider's foot on the footplate and supporting roller, the upper edge of the rim must pass the rider's leg. To accomplish this, the rim is caused to roll at a slight tilt outward so that, while the road contacting point is under the center of the foot, the upper portion of the rim passes outside the leg, being so guided by a shield and light strap which at once secures the rider's foot on the foot plate and the leg with respect to the frame member.

A rim-wheel device is attached, one to each foot of the rider. The propulsive motion is the same as general skating. With this device, where the rims are generally provided with elastic tires, the roller friction is low in the direction of the wheel plane or travel, while the friction of skidding or lateral to the rim, as in the propulsive stroke, is very high. Thus the propulsive efficiency is very high, comparable with ice skating.

Another feature is incorporated which is essential to safety and maneuverability, i.e., effective braking action. Offset from the footplate, both at the heel and the toe, are brake shoes. In normal travel, either propulsive or coasting, the weight is kept level on the footplate and the brake shoes are not in contact with the rim. For braking, the weight is transferred toward the heel of the foot, rotating the footplate about a transverse axis so that the heel is depressed toward the rim, forcing the brake shoe into contact with the rim to the degree required for the desired braking effect. Alternately, either to initiate the initial backward lean or to continue braking, as with the rearward wheel, foot pressure toward the toe can actuate braking. The movement and weight translation is in the natural backward lean for stopping as when walking or running. The degree of lean, which may be accentuated by backward squatting, can provide the balancing force available from the friction of the tire with the roadway. This braking force is available while facing straight on, as with a bicyle, rather than by abrupt turning to provide skidding braking as with roller or ice skating. With a bicycle the stopping deceleration is limited by the height of the center of gravity of the rider above the wheel to road contact. With the new device, squatting posture reduces this limitation. Thus, the braking capability is believed to be much greater than with any of the earlier devices. The competitive advantages of the new propulsive device in relation to prior devices will appear.

These and other objects and advantages of the invention, as well as the details of an illustrative embodiment, will be more fully understood from the following description and drawings, in which:

DRAWING DESCRIPTION

DETAILED DESCRIPTION

Figure 1:
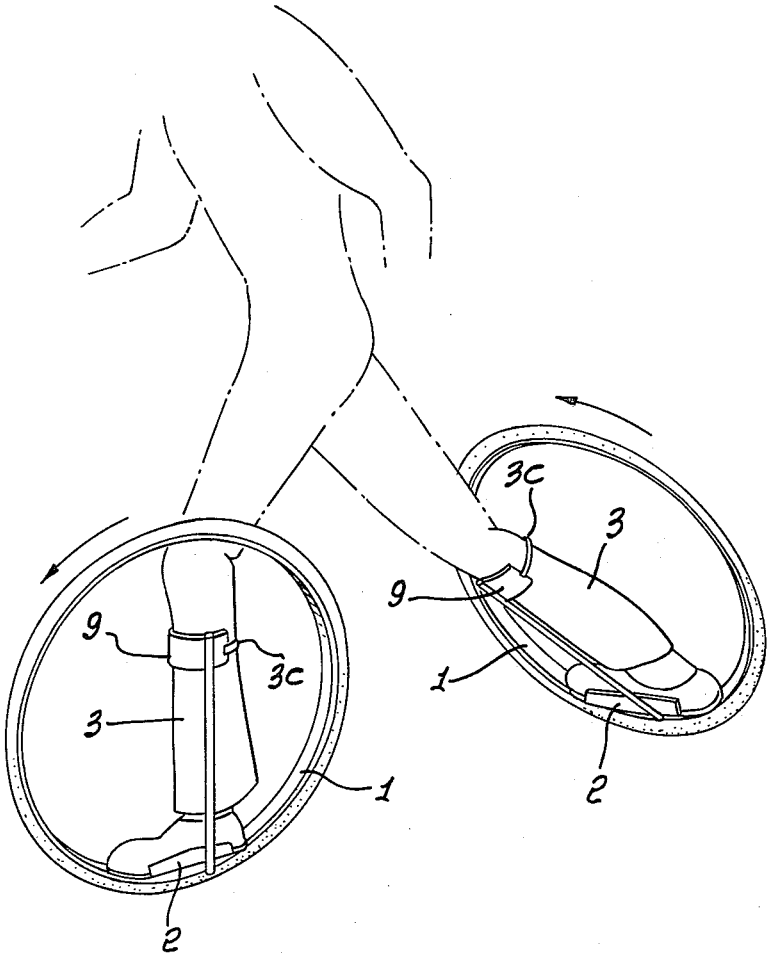
FIG. 1 is a perspective view of a rider using a pair of the uni-wheel skates of the invention.

FIG. 1 shows the basic arrangement of the pair of self-propulsion devices as utilized by the rider in the act of stroking. The wheel-rim, 1, passes under the footplate 2, and returns at the outerside of the rider's leg 3.

Figure 2:
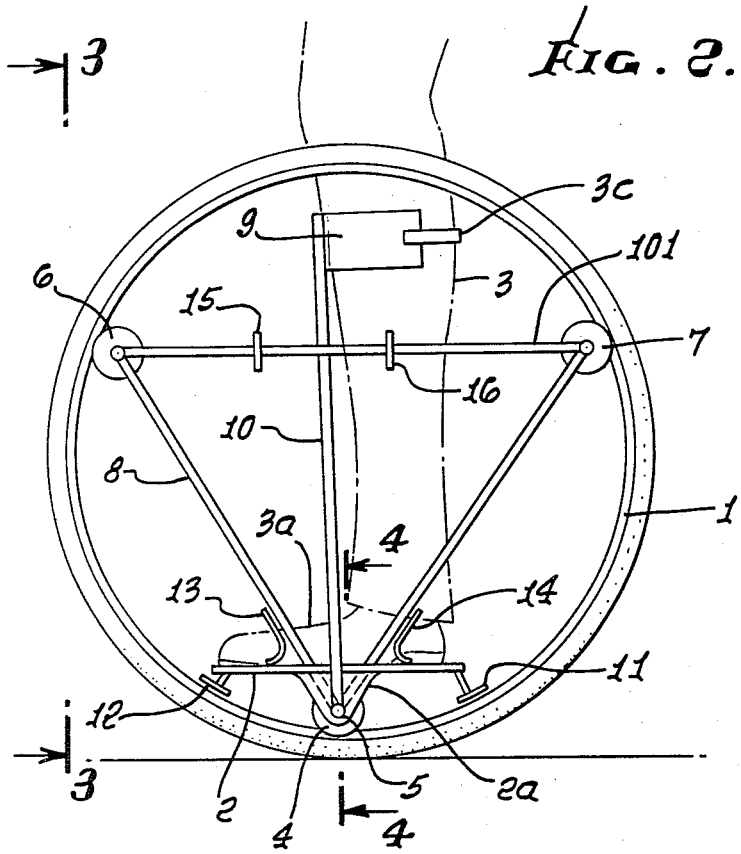
FIG. 2 is an enlarged side elevation of a uni-wheel skate device.

FIG. 2 shows a schematic side view of the device looking at the left foot as seen from the left. Shown at 1 is the rotating wheel-rim of the device, and the footplate which supports the rider's left foot appears at 2. It is understood that there is a similar device mounted on the rider's right foot, in opposition. The numerals 3 and **3*a*** represent the rider's leg and foot in relation to the device. The weight of the rider is principally supported upon the rim by the primary satellite support roller, 4. The shaft 5 of the support roller, 4, is connected by a bracket 2*a* to the footplate. There are two additional satellite rollers, 6 and 7, which are interconnected to the support roller by a frame 8, which accepts at its lower extremity an extension of the shaft 5, as shown in FIG. 4. The angular or leaning relation of the rotating rim 1, with respect to the rider's leg, is shown in the front view of the device in FIG. 3. The rim is guided within the plane defined by the three rollers 4, 6, 7, by flanges on each of the rollers. See for example flanges 4*a* in FIG. 4. The interconnecting frame 8 establishes the lean of the rim by virtue of the direct attachment of the rollers 6 and 7 to the frame, and the displaced attachment of the roller 4, on its shaft 5, and the support of the footplate 2 above the roller 4. The frame is also oriented with respect to the rider's leg by a leg guide plate 9, which is adjustably attached to a separate support member 10. The latter is attached to a collar 10*a* over the shaft 5, so that it may rotate in a plane perpendicular to the shaft 5. The curved leg plate 9 partially surrounds the forward segment of the leg. The leg is generally gently strapped at 3*c* against the guide plate. In this manner, the frame 8 is held in a relatively fixed relation laterally to the rider's leg, but can rotate in the plane of the frame relative to the leg. Thus, the lean of the rim and the clearance of the rotating rim past the rider's leg are assured. Also, in this manner the rider is not required to exert great control of the lateral relation of the rim to the leg or body by delicate ankle control as in roller or ice skating.

Figure 3:
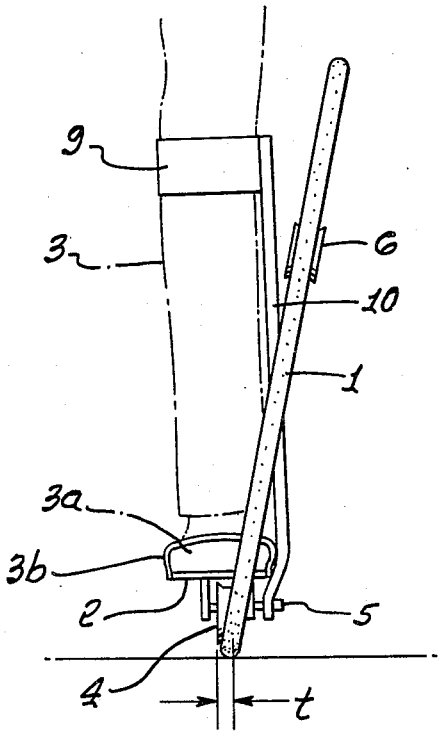
FIG. 3 is an end elevation on lines 3—3 of FIG. 2.
Figure 4:
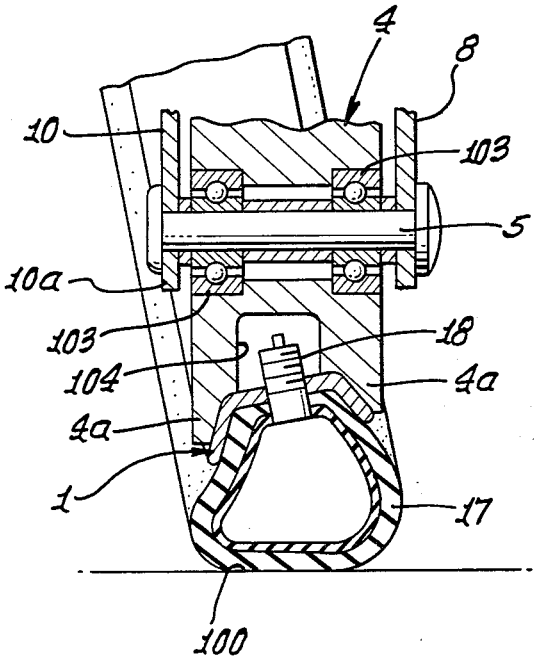
FIG. 4 is an enlarged section taken through a lower portion of the FIG. 2 uni-wheel skate, on lines 4—4 of FIG. 2.

The lateral relation of the footplate 2, with respect of the contact point, or small footprint area of the rim/tire on the ground at 100 in FIG. 4 is such that the vertical force vector of weight transmitted through the leg and footplate is somewhat inside the ground contact point as shown in FIG. 3 (see offset "t") furnishing a leaning torque in opposition to the leg plate, so that the leg is generally pressed gently against the leg plate. The rotating support member 10, can however, rotate with respect to the frame 8, in a fore-and-aft direction. This rotation is in response to ankle flexure fore and aft as the rider may shift his weight between toe and heel as in the natural mode of standing erect. This natural motion control of the ankle is essential for preservation of balance control on the device as described below. The foot 3*a* is gently strapped at 3*b* to the footplate 2, so that twisting motion of the foot, transmitted through the leg and ankle, is imparted through the frame 8, and guide rollers 6 and 7 to the rim 1, to guide the direction of the rim and thus the rider's path along the ground. Thus the devices attached to the two feet and legs are separately guided, so as to steer the motion of the rider by twisting motion of the rims through the feet, while the essential control force for executing turns is imparted by leaning the body and thence either or both legs and thence through the guideplate 9, and support member 10, to cause the rim or rims to lean with the rider into the turn.

For the necessary slowing of the rider, braking action is accomplished as follows. Referring to FIG. 2, a brake pad 11, is attached to and behind the footplate 2, and a second pad 12 forward of the footplate. When the footplate 2, is rotated backward, this rotation is transmitted to the frame 8 through a compliant constraining spring 13. Likewise, the footplate 2, can be rotated slightly forward along with the frame 8, through a second spring 14. To apply braking, the footplate must be rotated with respect to the frame 8. The force of rotating the foot is supplied through the leg at the ankle joint. The counter force to supply the rotation of the footplate 2, relative to the frame 8, must be supplied by the leg against the frame. The leg is tied to the strut 10 and guide 9. Therefore, the counter force of the leg against the frame 8, is permitted to occur only after the footplate 2 and frame 8 have been turned sufficiently with respect to the strut 10, so that the stop 15 on the frame member 101 has come into contact with the strut 10. Only light pressure of the springs 13 and 14 is required for the footplate to turn the frame 8 for general running and balance. Having contacted the stop 15 in the case of backward lean, or the stop 16 in the case of forward lean, the strut is now locked to the frame, and further rotative force through the ankle can now let the foot rotate the footplate with respect to the frame against the pressure of the spring and depress the brake against the rim. When the rider forcibly rotates his foot backward as when leaning or rearing backward with one or both feet, legs and body in the natural manner or the motion of slowing or stopping when walking or running, such rotating motion of the footplate 2, around the shaft 5 with respect to the frame 8, presses downward on the brake pad 11 against the rim. Likewise, if the backward lean is initiated first by toe pressure on the footplate, then the brake pad 12 is pressed against the rim to apply braking action. The braking motion is natural because a backward lean is necessary so that a component of gravitational force acting through the body is transmitted to the ground running surface. Dependent on the course of the braking action, and on which foot is forward or back in the stance, the braking may be applied by either toe and heel action of either foot. In addition, the dual brake scheme furnishes redundancy in the braking system for safety. It is anticipated that the most vigorous braking action will be applied when the rider squats into a backward lean with one foot well forward applying heel brake, and sitting toward the rearward foot applying toe brake.

The detail of FIG. 4 shows the support roller 4 in rolling contact with the rim 1. See also shaft 5, and bearings 103 supporting the roller 4 and elements 8 and 10 for rotation on the shaft. When using a standard bicycle wheel rim and tire 17, since the rim is tilted with respect to a vertical plane, and it is desirable that the shaft 5 be horizontal, transmitting only a radial load through bearings 103 to the roller 4, the outer surfaces of the roller will be essentially and normally vertical, and the circumferential contact of the roller with the rim must be in angular disposition with respect to the axis of the roller 4. Further, the normal rim and tire require a valve stem 18 that projects through the rim at one location on the circumference of the rim. This valve stem must pass each of the rollers 4, 6 and 7, in turn. Therefore, each roller has a groove 104 around its center plane of sufficient width and depth to permit the valve stem to pass. By contrast, the rollers 6 and 7, may be so oriented in an angular manner with respect to the frame 8 so that the side planes of each roller will be parallel to the plane of rotation of the rim. Hence, the rollers 6 and 7, will be symmetrical.

The maintenance of balance when standing on this wheeled device dictates certain design details. It is preferable that balance for retaining an upright stance be achieved in the same manner as when a person stands on the ground. If a person's feet are separated, one in front of the other, balance is established by the automatic adjustment of the force transmitted through either leg to the feet as the center of body weight is shifted fore and aft either intentionally or casually. However, if the feet are exactly side by side, or when standing on one foot, the fore and aft balance condition is inherently unstable. Upright stance is maintained only by constant delicate manipulation of the muscles (principally Gastronemius and Peronaei) that control ankle movement. This muscle control alternately shifts the ground contact force toward heel or toe as the body weight moves fore and aft. These motions and the delicate muscular control of the ankle movement must be learned early by a child if he is to be able to stand and walk erect. It is desirable that any alternative device on which a person is to stand should be designed to utilize these same learned body controls to assure vertical stance. (Riding a unicycle is an example of an unnatural balance requirement, i.e. a new motion must be learned for stability). If the rim 1 is very large in diameter so that the center of the rim circle is well above the center of gravity of the body, then the body can be locked into the rim system and fore and aft balance will automatically hold the body in the erect orientation. If the rim is of small diameter and the center of the rim circle is below the center of gravity of the body, then if the body and rim are locked together, the body will no longer be stable but will fall forward or backward. For natural stability on this device the leg cannot be fastened to the rim or frame, as if the leg guide plate 9, were fastened to the upper member of the frame 8. It is necessary that natural movement of the ankle must cause the resultant upward support vector transmitted from the ground up to the foot through the rim and footplate to move fore and aft to keep the center of gravity of the body always within the moving bounds of the vertical force vector. The action is illustrated when standing on ice skates. The longitudinal curvature of the blade is called "rocker". There may be relatively little curvature or a perfectly straight edge as on racer skates. The blade is more curved on hockey or figure skates. For longitudinal stability the skate must rock fore or aft, changing the fore and aft location of the ground contact point force in response to the actuation of the ankle. Similarly with roller skates, the front and rear wheels must be adequately separated so that most people can achieve balance within these limits. If one's center of gravity is allowed to move ever so slightly beyond the front or rear axle, then corrective ankle action will initiate the familiar forward or backward spill. In the present device the necessary action is less obvious and more demanding of careful design. If to correct a slight forward lean the ankle, connected through the foot 3, and footplate 2, is rotated forcibly forward with respect to the leg by pushing downward at the toes, two alternative effects may result. If the rim is locked to the ground, then the footplate 2, and rollers 4, 6 and 7 within frame 8, will rotate in the rim so that the resultant force applied by the foot will still go through the same contact point of the tire with the ground. This is not a stabilizing motion. Alternately, if the rim is allowed to roll and the foot and ankle do not move horizontally, then the added force on the toes will press forward on the roller 6, causing the rim to rotate and move forward until the contact point of the rim with the ground is under the resultant force applied to the body system from the ground support. The opposite actions may be described when the ankle action causes a transfer of resultant foot force toward the heel.

The choice between these two motions, the first destabilizing, and the second stabilizing, is dictated by the dynamics of the system. Unless the rolling friction or adhesion of the rim/tire with the ground is excessive, the second motion will prevail. The reason is that the rim/tire assembly is lighter than the footplate, foot, leg assembly. Therefore, in response to a sudden forward pressure on the footplate by the ankle, the greater inertia causes the foot to remain relatively motionless, while the rim rotates forward to allow the contact point with the ground to move forward. The motions described are pertinent when on one foot, or when the two feet are exactly side by side. Fore and aft separation of the feet eases stability. If in standing directly on the ground ankle action is insufficient to stabilize a degree of lean, one may step forward with one foot to regain control. Likewise, one may step forward with the subject wheeled device. The condition of excessive friction or adhesion with the ground, which may limit stationary natural stability, will also supply the necessary horizontal force component to initiate a forward step. This discussion explains the discovery and necessity that the leg guide plate 9 and strut 10 must not be connected to the frame 8, but rather that the frame must be permitted to rotate with respect to the leg, and that the leg plate 9 must be otherwise connected to the system only at the shaft 5, by a separate support member 10.

There are two modes for lateral stability. The narrow contact area or footprint of the tire on the ground negates the normal stabilization of lateral ankle control that permits a person to stand on the normal wide contact footprint and maintain balance. The present device is similar to the case with ice skates. For stationary stability it is necessary that the feet be laterally displaced. When in rolling motion or when in sliding motion on ice skates, stable coasting on one foot can be maintained by steering a course so that the falling leaning rotation to one side or the other is counteracted by initiating a turn in that same direction, causing the central force of the turn to supply the required corrective rotation. This, of course, is the same stabilizing means and path required for riding a bicycle stably. The path can never for long be a perfectly straight course.

Figure 5:
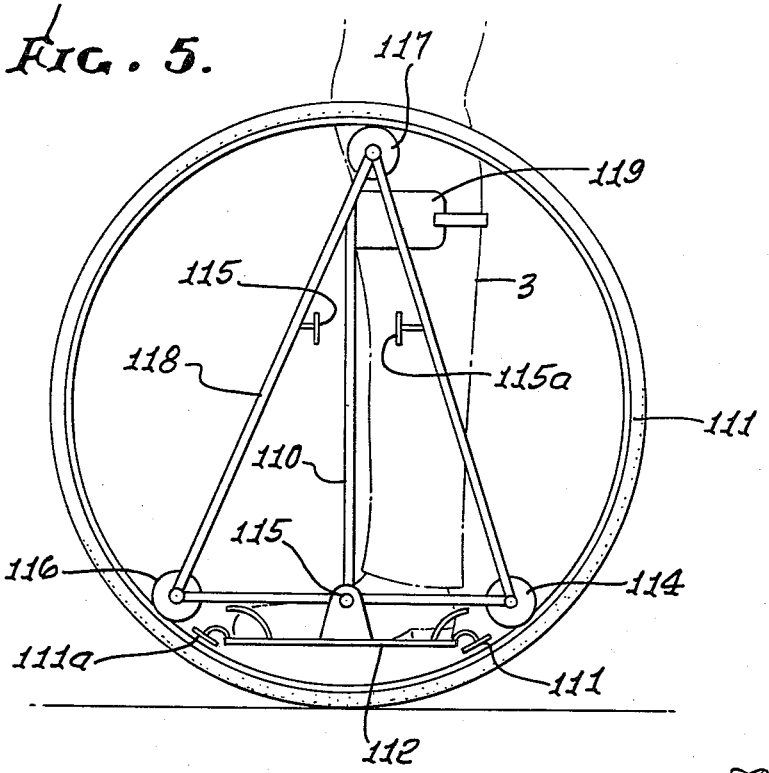
FIG. 5 is a view like FIG. 2 but showing a modification.

An alternative assembly of the mechanism that permits all the necessary stabilizing action is shown in FIG. 5. In this case, the support of rider weight with respect to the rim 111, is provided by two rollers 114 and 116, that are situated before and behind the footplate 112. Depending on the radius of the rim and the necessary length of the footplate and foot, it may be possible to place the foot closer to the ground than in FIG. 2. The third roller 117, which is essential to assure the retention of the the frame 118 within the rim 111 is in this case located directly above the footplate 112. The three rollers may be interconnected by the triangular frame 118, as in the first case. A separate support strut 110 is provided for the leg guide plate 119. Shaft 115 corresponds to shaft 5 above. Stops 115 and **115*a* correspond to 15 and 16, and brake pads 111 and 111*a* correspond to 11 and 12**.

Figure 6:
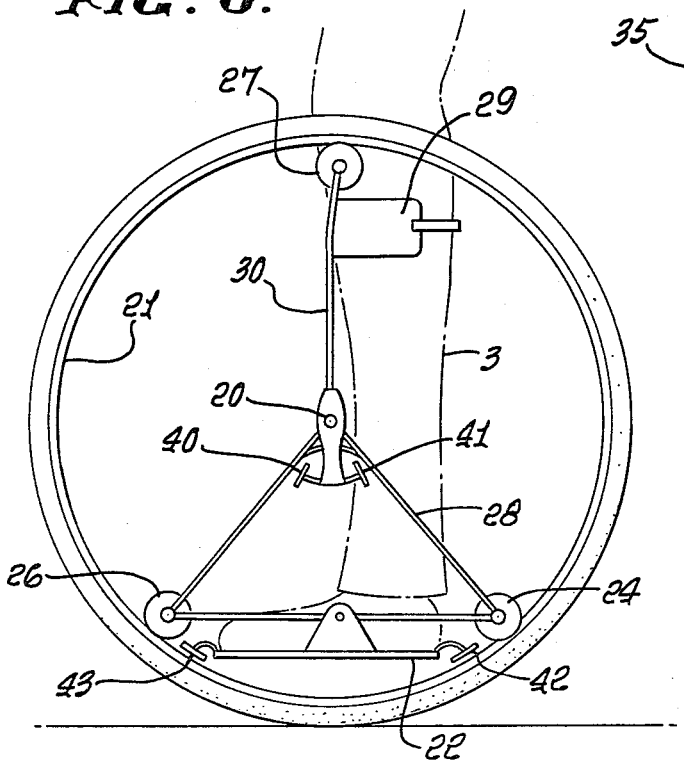
FIG. 6 is another view like FIG. 2, but showing a modification.

Still another variation is shown in FIG. 6. The upper roller 27 may be allowed a variable disposition around the rim 21 with respect to rollers 24 and 26, provided that the three rollers remain on the same circle; and two never are diametrically opposite. This condition may be assured by a frame which connects roller 27, through an arm 30 which rotates over a limited angle around the center 20 of the circle defined by the rim. The advantage is that now the leg guide plate 29 may be connected to the arm 30 of the frame while still permitting the necessary rotation of the footplate 22 in response to ankle motion. See also frame member 28. Arm 30 serves as both a leg support and as part of the frame. Stops 40 and 41 correspond to 15 and 16; and brake pads 42 and 43 correspond to 11 and 12.

Figure 7:
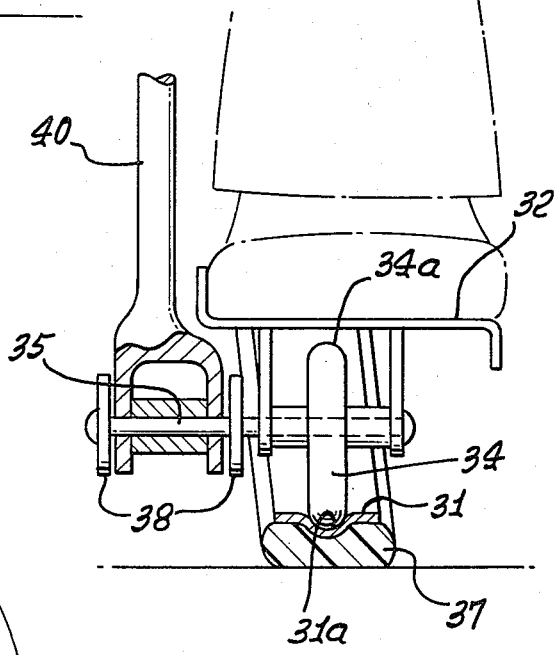
FIG. 7 is a view like FIG. 3 showing another modification.

In all schemes the conventional bicycle rim, pneumatic tire and valve assembly may be replaced by a somewhat different assembly. FIG. 7 shows in section a simple rim 31, having a central circumferential groove 31*a* of half-circular section. The rim may be rolled from flat stock. The tire 37 is not pneumatic, but is presumably of elastomeric stock, chosen for durability, to roll easily longitudinally, but have good friction when retarded with respect to the rolling surface. In this case the rim engaging rollers as at 34 are thinner than in FIG. 4, and instead of having flanges, can have a circular edge (as at 34*a*) to mate with and be retained in the groove 31*a* of the rim. It is also advantageous that the section of the rim be skewed with respect to the plane of the rim by the tilt angle of the rim with respect to the ground, so that the weight bearing roller 34 will bear symmetrically on the rim and tire. In this case, the guide rollers although set in the plane of the rim, will bear asymmetrically in the groove. FIG. 7 also shows schematically a possible configuration of the footplate assembly 32, the frame 38, the leg brace strut 40 and roller 34, all connected rotationally by the shaft 35.

Several advantages attend the combination of features of this invention. The rim and tire should be less expensive; the weight of the rim and tire should be less, facilitating the dynamic relative movement of rim versus frame required for stability; there being no valve system, the rim and rollers need not provide for this and are therefore simpler.

Figure 8:
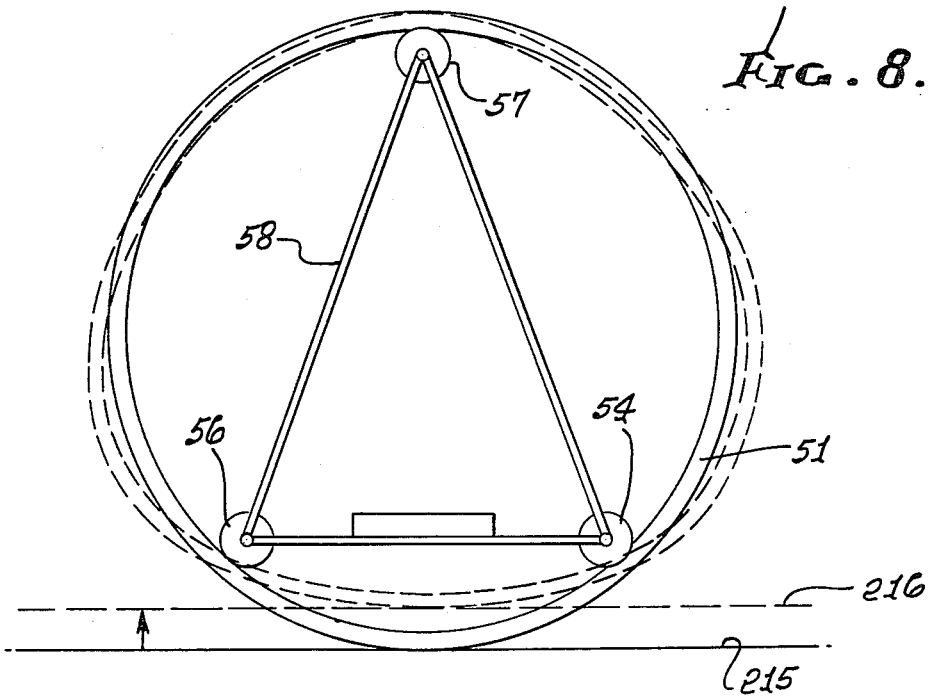
FIG. 8 is a side elevation showing a flexible rim uni-wheel skate.

Still other advantages attend the incorporation of substantial flexibility in the rim. The support of the rider on separated rollers 4 and 6, must be transmitted through the rim to the contact area of the rim with the running surface. A softer ride is assured by greater flexibility, perhaps greater than provided by a pneumatic tire. By choice of rim the flexibility may be matched to the rider's weight. When encountering a discontinuity in the running surface, like a bump, the flexure of the rim will distribute the contact over a longer length of rim/tire, thus generating temporarily a flatter rocker and augmenting stability. The flexure of the rim is not limited to the space between the rollers 4 and 6. As shown in FIG. 8, the bending stiffness of the rim 51 assures that when the length between the rollers 54 and 56 is flattened, the lengths between rollers 54 and 57, and 56 and 57, will be flexed to shorter radius. Because of fixity at roller 57, the flexure is transmitted even across that roller. Thus the entire perimeter of the rim participates in the flexure, resulting from changes of load at the contact region with the roadway. See roadway levels 215 and 216. See also frame 58.

In all cases in the execution of the mechanism of this invention, it is imperative that the rollers run very freely on their shafts, preferably using high grade ball bearings, and that the rollers run smoothly along the rim. If this is not the case, then the rim and tire will tend to slow or stop when each foot is alternately raised after a stroke. Then, when the foot is swung forward into supportive contact with the running surface, the rim and tire must be accelerated to running speed, with attendant depletion of energy from the system.

As shown in FIGS. 5 and 6, springs 113 correspond to springs 13 and 14 in FIG. 2.

I claim:

1. A uni-wheel skate, comprising (a) a circular wheel having a rim arranged to rotate about a generally tilted axis so that the rim rotates in a plane which is generally tilted relative to vertical, (b) a frame relative to which the rim rotates, (c) satellite rollers rotatably attached to the frame and engaging the rim so as to determine the relative rotation of the rim with respect to the frame, and (d) support means carried by the frame to receive the load of the rider's foot for transmission of the rider's body load to and through the frame and rollers to the wheel, said support means comprising a foot plate which is rotatably mounted to the frame to be rotatable relative thereto, (e) and including a separate support associated with the frame to be rotatable relative to the frame, said separate support engageable with the rider's leg to maintain stability.

2. The skate of claim 1 wherein said plate means has a foot support surface located below the level of said axis.

3. The skate of claim 1 including brake means operable in response to rotation of the foot plate relative to the frame, said brake means including brake pad means engageable with the rim.

4. The skate of claim 3 wherein said brake pad means includes fore and aft brake pads on the footplate and respectively engageable with the rim in response to fore and aft rocking of the footplate relative to the frame.

5. The skate of claim 3 including stop means on the frame to limit said rotation of said separate support relative to the frame.

6. The skate of claim 5 wherein said stop means include fore and aft stops respectively located on the frame in fore and aft relation to said separate support.

7. The skate of claim 6 wherein the stops are positioned in the paths of rotation of the separate support to be engaged thereby, allowing said footplate rocking by the rider's foot, and relative to the frame.

8. The skate of claim 5 including yieldable means for yieldably resisting rotation of the footplate relative to the frame, prior to said operation of the brake means.

9. The skate of claim 8 wherein said yieldable means include fore and aft springs respectively located on the footplate in fore and aft association with said fore and aft brake pads.

10. The skate of claim 1 wherein said satellite rollers include two rollers above the level of said wheel axis, and a single roller below the level of said wheel axis.

11. The skate of claim 1 wherein said satellite rollers include at least one roller below the level of said wheel axis, and said one roller defines a second axis of rotation, said footplate and said separate support also being rotatable about said second axis.

12. The skate of claim 1 wherein said satellite rollers include one roller above the level of said wheel axis, and two rollers below the level of said wheel axis.

13. The skate of claim 1 wherein said satellite rollers are grooved to pass a valve stem associated with the wheel rim.

14. The skate of claim 1 wherein said satellite rollers have flanges located to straddle the rim.

15. The skate of claim 1 wherein said rim is resiliently flexible to assume a slightly out-of-round configuration under variable loading imposed by a rider on the footplate or by the roadway.

16. The skate of claim 15 wherein the flexible rim is grooved to receive said satellite rollers.

17. The skate of claim 1 wherein said rim is grooved to receive said satellite rollers.

18. The skate of claim 1 wherein said leg support is carried by the frame.

19. The skate of claim 1 wherein said separate support is pivotally mounted to rotated about an axis defined by the rim.

20. The skate of claim 19 wherein one of said satellite rollers is carried by said separate support.

21. The skate of claim 19 wherein the stops are positioned in the paths of rotation of the separate support to be engaged thereby, allowing said footplate rocking by the rider's foot, and relative to the frame.

* * * * *